United States Patent [19]

Boone

[11] Patent Number: 4,902,016

[45] Date of Patent: Feb. 20, 1990

[54] GOLF CLUB HEAD HAVING A HIGH FRICTION STRIKING SURFACE

[75] Inventor: David D. Boone, El Toro, Calif.

[73] Assignee: Lynx Golf, Inc., City of Industry, Calif.

[21] Appl. No.: 229,265

[22] Filed: Aug. 8, 1988

[51] Int. Cl.[4] ..... A64B 53/04

[52] U.S. Cl. ..... 273/175

[58] Field of Search ..... 273/175, 167, 167 D, 273/183 D, 169, 173, 174, 78, 168

[56] References Cited

U.S. PATENT DOCUMENTS

| | | | |
|---|---|---|---|
| 1,535,670 | 4/1925 | Kidd | 273/175 |
| 1,927,083 | 9/1933 | Davis | 273/175 |
| 4,529,203 | 7/1985 | Ribaudo | 273/175 |
| 4,802,672 | 2/1989 | Long | 273/175 |

OTHER PUBLICATIONS

"Rules of Golf 1986", United States Golf Association, Far Hills, N.J., pp. 92 & 93.

*Primary Examiner*—George J. Marlo
*Attorney, Agent, or Firm*—Leonard Tachner

[57] ABSTRACT

An improved golf club head having a face or ball striking surface comprising a plurality of dimples, punch marks or depressions each of which is at least 0.02 inches deep and which, in a preferred embodiment, is characterized by a cross-section of truncated conical shape having a planar base having a diameter of at least 0.04 inches and a curved upper portion for merging tangentially into the adjacent face surface to form a surface diameter of at least 0.06 inches. A large array of equally spaced depressions provide substantially constant friction or spin force on the golf ball irrespective of angular deviations of the face from perpendicularity with the ball striking direction of the club head at the point of impact. The inventive club head is particularly advantageous in high loft configurations such as a wedge.

2 Claims, 1 Drawing Sheet

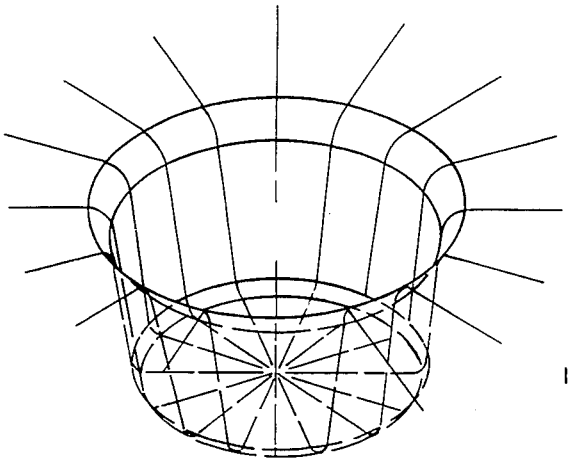
FIG. 1
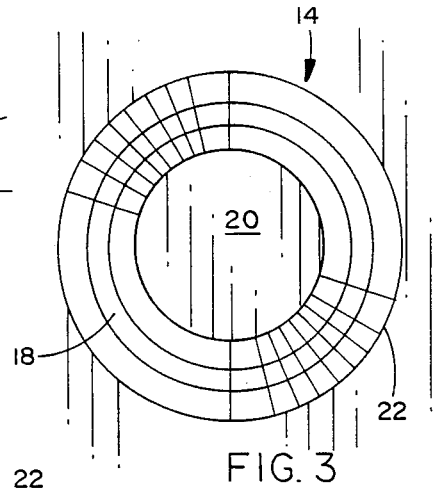
FIG. 3
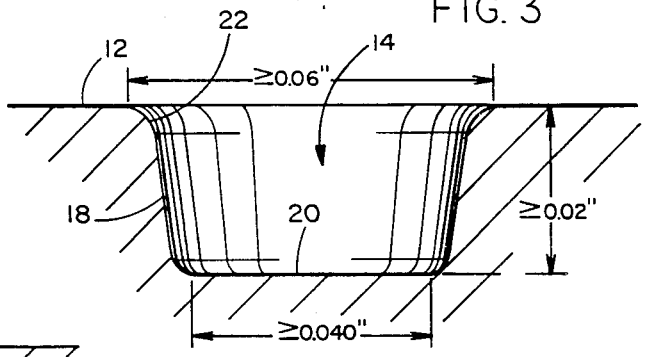
FIG. 2
FIG. 5
PRIOR ART
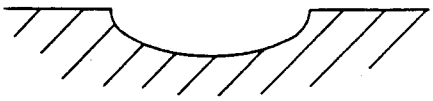
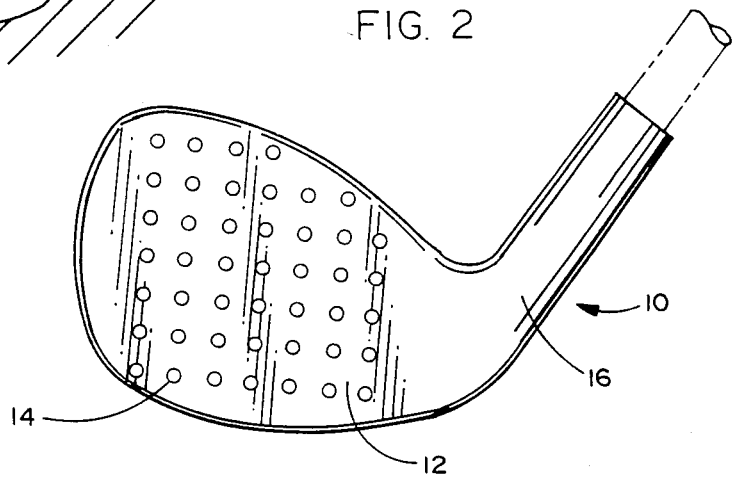
FIG. 4
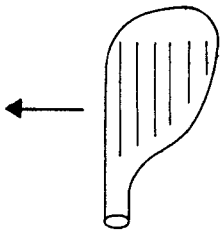
FIG. 6
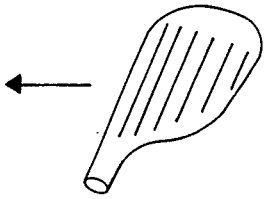
FIG. 7
FIG. 8
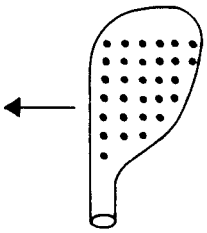
FIG. 9
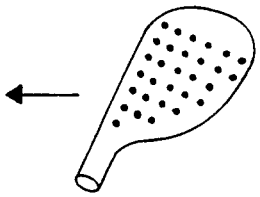

GOLF CLUB HEAD HAVING A HIGH FRICTION STRIKING SURFACE

BACKGROUND OF THE INVENTION

1. Field of the Invention

The present invention relates generally to the golf clubs and more specifically to a golf club face or ball striking surface having dimples or depressions of selected cross-section for increasing the friction or spin characteristics between the face of the club and the ball.

2. Prior Art

It is common knowledge that golf clubs used for striking a golf ball from the teeing area to the green have a series of grooves, score lines or punch marks to help align the club head at the address to the ball and to provide optimum friction to take place at impact when the club head comes into contact with the ball. Such grooves, score lines or punch marks must meet specifications in rules set forth by the applicable golf association such as the United States Golf Association. Until relatively recently the United States Golf Association had rules severely limiting the use of grooves, score lines or punch marks on the striking surface of golf clubs. More specifically, such rules held that grooves, score lines or punch marks could only be used as decorative marking. However, in 1985 the United States Golf Association changed the rules allowing grooves in the ball striking face of golf club heads with shapes that clearly serve more than just a decorative purpose. More specifically, the 1985 rules change permitted the use of grooves having sufficient depth and shape to have some effect on the ball. Thus, it is possible as a result of the aforementioned rule change for a manufacturer of golf clubs to develop a groove or score line that can improve the friction characteristics that can occur at impact between the club head and the golf ball. For example, the ball hitting surface can now include sufficient score lines of such shape to permit the imparting of spin on the ball to produce an intentional curve in flight such as a hook or slice or to generate a higher or lower trajectory than might otherwise occur based solely upon the shape of the club head.

Unfortunately, prior art golf clubs using grooves or score lines tend to be directional in that the frictional effects on the golf ball tend to be dependent upon the angle of impact between the golf club face and the ball relative to the direction of the stroke. Consequently, if the golf club head is not perfectly square at impact, each time the ball is struck there is a lack of consistency which tends to diminish the degree of control that the golfer exerts over the trajectory of the ball thereby reducing the golfer's performance and enjoyment of the game. In addition, such prior art grooves or score lines are very susceptible to being affected by the playing conditions. For example, if the ball is around rough or wet grass or any other form of foreign material has adhered to the ball or golf club face, the degree of friction between the golf club face and the ball in the conventional grooved or score lined configuration is significantly affected. Although punch marks, unlike score lines, are not necessarily affected to any degree by the orientation of the club head, conventional decorative dimple marks tend to be too shallow to have any significant impact on the frictional characteristics between the golf club head and the ball.

There has therefore been a long-felt need for an improved golf club having a ball striking surface or face which can deliver sufficient friction to impart a desired degree of spin or other control characteristics to the ball under a wider range of playing conditions and with a substantial degree of consistency irrespective of the orientation of the golf club head relative to the ball.

SUMMARY OF THE INVENTION

The present invention satisfies the aforementioned long-felt need by providing an improved golf club head which is capable of delivering more friction and thus more spin to a golf ball under a wider range of playing conditions producing more consistent results under the conditions that can be encountered during normal play of the game of golf. The invention comprises a golf club head having a plurality of truncated cone-shaped dimples or depressions to more efficiently and consistently apply the proper amount of friction without departing from the limitations of rules set forth by the United States Golf Association. The unique depressions are provided in a large array or pattern which overcomes the prior art disadvantage of directional dependency found using golf club heads having conventional grooves or score lines and provides a significant increase in the degree of friction imparted by golf club heads having ordinary decorative punch marks. As a result, the present invention provides the golfer with a greater degree of ball control despite deviations in the angle of the golf club face relative to the direction of the stroke at the time of impact and also particularly when the impact is intentionally deviated from normal positions in order to intentionally produce a curved flight such as a hook or slice or higher or lower trajectory. Furthermore, the invention is capable of producing such results consistently under conditions that can be encountered during normal play of the game of golf.

OBJECTS OF THE INVENTION

It is therefore a principal object of the present invention to provide an improved golf club head, the face of which is characterized by a plurality of uniquely shaped punch marks which impart a greater degree of friction or spin to the ball upon impact than is typical of prior art golf club heads.

It is an additional object of the present invention to provide an improved golf club head, the ball striking surface of which comprises a plurality of deep punch marks each having a cross-section which may be characterized as being substantially a truncated cone for increasing the friction between the golf ball and the ball striking surface.

It is still an additional object of the present invention to provide an improved golf club head, the ball striking surface of which comprises a plurality of uniquely shaped deep punch marks for applying a selected degree of friction between the striking surface and the ball, substantially independent of the angle between the striking surface and the direction of the stroke.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the accompanying drawings in which:

FIG. 1 is an orthographic projectional view of the punch mark of the present invention;

FIG. 2 is a cross-sectional view of the punch mark of FIG. 1;

FIG. 3 is a top view of the punch mark of FIG. 1;

FIG. 4 is a plan view of an illustrative array of the punch marks of the present invention shown on a club head face;

FIG. 5 is a cross-sectional view of a typical decorative punch mark of the prior art;

FIGS. 6 and 7 illustrate alternative angular relationships between a prior art golf club head and the ball which substantially affects the degree of friction applied to the ball; and FIGS. 8 and 9 are views comparable to those of FIGS. 6 and 7 but illustrating the use of the present invention which provides the advantage of not substantially modifying the degree of friction applied to the ball.

DETAILED DESCRIPTION OF A PREFERRED EMBODIMENT

Referring first to FIGS. 1–4, it will be seen that the golf club head 10 of the present invention comprises a hosel 16 and ball hitting surface or face 12 having a plurality of dimples or punch marks 14 the detailed structure of which may be seen best in FIGS. 1–3. Each such punch mark 14 is of a truncated conical configuration having a tapered side wall 18 terminating in a planar base or floor 20 and having a top or rim 22 which is of a curved configuration for merging tangentially with the golf club face 12. In a preferred embodiment the distance between the face 12 and the base 20 of each punch mark 14 is 0.028 of an inch while the diameter along the surface 12 is 0.063 inches and the diameter along the base 20 is 0.047 inches. The radius of rim 22 is 0.014 inches.

This configuration of the punch mark of the present invention differs significantly from the typical decorative punch marks normally provided in conventional golf club heads such as that illustrated in FIG. 5. By way of example, a conventional punch mark has a maximum depth of no greater than 0.010 of an inch. The greater depth and unique shape of the punch mark of the present invention permits a substantial displacement of the ball surface into the punch mark upon impact with the ball, thereby providing a significantly greater degree of contact friction between the face 12 and the ball.

The punch marks 14 are preferably arranged in a large array such as that illustrated by way of example in FIG. 4. However it will be understood that the specific number of punch marks and the array configuration thereof, are not deemed to be limiting of the present invention. It is generally preferable however that the number and position of the punch marks are appropriate for assuring contact between at least several of such punch marks and the ball during the impact portion of the stroke.

The significant advantage derived from the present invention may be understood best by referring to FIGS. 6–9. In FIGS. 6 and 7 it will be seen that when the angle between a conventional score lined or grooved golf club head relative to the direction of ball impact, is altered, there is a significant reduction between the striking or face surface and the ball due to the non-zero angle between the direction of the grooves and the direction of the stroke. On the other hand, as illustrated in FIGS. 8 and 9, when the angle of the golf club head utilizing the present invention, is altered by the same angle as that shown in FIG. 7 relative to FIG. 6, the friction between the striking surface and the ball remains substantially constant because of the circular configuration of the dimples 14 relative to the ball and the direction of the stroke. Virtually identical surface characteristics are presented to the ball and the indentation of the ball surface relative to the golf club face 12 remains substantially the same. As a result, the golf club head utilizing the present invention delivers improved friction which translates into more spin under a wider range of playing conditions including rough or wet grass and other foreign materials as compared to golf clubs using grooves, score lines or conventional punch marks.

When a club impacts the golf ball, which is a stationary object just prior to impact, the club head ordinarily will twist around the shaft axis and the center of gravity of the head. Furthermore, it is common to inadvertently impact the ball without the face of the club being square, that is, without being precisely perpendicular to the direction of the stroke. Either of these conditions will provide inadvertent angles between the golf club head and the stroke direction which will, in the conventional golf club head, result in an inconsistency in the degree of friction between the face of the club head and the ball thereby producing inconsistency in the performance of the club. In addition, it is occasionally desired to intentionally impact the golf ball with the club head at an angle to produce a desired result that can be only obtained from a ball that is intentionally curved in flight such as an intentional hook or slice or a higher or lower trajectory than might ordinarily occur if the ball were impacted square. The score lines or punch marks of prior art club heads will not produce the results desired consistently under conditions that can be encountered during normal play. Fortunately however, the present invention utilizing the truncated cone punch mark or dimple 14, more efficiently and consistently applies the proper amount of friction or spin to the ball that is required or desired and is therefore an improvement over all such face scoring configurations available in the prior art.

It will now be understood that what has been disclosed relates to an improved golf club head and more specifically, to a golf club head having a ball striking surface or face which utilizes a uniquely shaped dimple or punch mark preferably provided in an array of a plurality of such dimples or punch marks, each such punch mark having a relatively deep truncated cone shape for significantly enhancing the degree of friction applied to the golf ball by the club face during the stroke. In addition, the omnidirectional characteristic of the dimple, particularly when it is provided in a substantially symmetrical array, renders the club head relatively insensitive to variations in angle between the face of club head and the ball relative to the stroke direction whereby to achieve a substantially greater consistency in performance irrespective of inadvertent or intentional variations in the angular positions of the golf club head relative to the ball.

Those having skill in the art to which the present invention pertains will now, as a result of the teaching herein disclosed, perceive various modifications and additions which may be made to the invention. By way of example, it will now be apparent that deep punch marks or dimples of other shapes and dimensions as well as alternative arrays of such dimples or punch marks may be provided to also significantly enhance the performance of the club and render the trajectory of the stroke ball relatively insensitive to the position of the golf club head at the point of impact. Thus, for example, while it is preferable to provide at least a 20 degree draft angle to enable pulling a casting from the mold, other methods of manufacture may permit drastically altered shapes of the depression of the present invention. However it will be understood that all such modifications and additions are deemed to be within the scope of the invention which is to be limited only by the claims appended hereto.

I claim:

1. An improved golf club head of the type having a planar ball striking surface; the improvement comprising:

a plurality of spaced dimples in said face, each said dimple being at least 0.02 inches in depth and having a truncated circular conical cross-section;

wherein each said dimple comprises a generally planar base having a diameter of at least 0.04 inches; and wherein each said dimple comprise a curved rim portion which merges tangentially into the adjacent ball striking surface to form a surface diameter of at least 0.06 inches.

2. The improvement recited in claim 1 wherein said dimples are equally spaced from one another and form an array for providing substantially the same spin on a golf ball imparted by the face irrespective of angular deviations of the face from perpendicularity with the ball striking direction of the club head at the point of impact.

* * * * *